US005158633A

United States Patent [19]

Rausing

[11] Patent Number: 5,158,633

[45] Date of Patent: Oct. 27, 1992

[54] METHOD FOR PRODUCING AN OPENING MEANS ON A PACK FOR LIQUIDS

[75] Inventor: Hans Rausing, Wadhurst, Great Britain

[73] Assignee: Tetra Pak International AB, Lund, Sweden

[21] Appl. No.: 639,971

[22] Filed: Jan. 11, 1991

Related U.S. Application Data

[60] Division of Ser. No. 75,281, Jul. 20, 1987, Pat. No. 4,998,668, which is a continuation of Ser. No. 826,066, Feb. 4, 1986, abandoned.

[30] Foreign Application Priority Data

Feb. 5, 1985 [GB] United Kingdom ..... 8502910

[51] Int. Cl.[5] ..... B65D 5/70; B32B 31/18

[52] U.S. Cl. ..... 156/223; 53/296; 53/133.4; 156/69; 156/293; 229/125.14

[58] Field of Search ..... 53/290, 296, 133.1, 53/133.2, 133.4; 493/87, 962; 222/541, 566, 573; 156/223, 293, 69; 229/125.14, 123.1; 220/90.6, 359

[56] References Cited

U.S. PATENT DOCUMENTS

| | | | |
|---|---|---|---|
| 2,347,686 | 5/1944 | Hothersall | 229/7 |
| 2,721,688 | 10/1955 | Beymer | 229/7 |
| 2,885,084 | 5/1959 | Rocca | 210/464 |
| 3,101,879 | 8/1963 | Meyer-Jagenberg | 229/7 |
| 3,883,034 | 5/1975 | Rausing | 220/268 |
| 3,977,591 | 8/1976 | Martensson et al. | 229/7 R |
| 4,116,359 | 9/1978 | Josephy | 29/509 X |
| 4,126,263 | 11/1978 | Martensson | 229/17 R |
| 4,170,314 | 10/1979 | Weierman et al. | 220/260 |
| 4,223,789 | 9/1980 | Reil | 206/605 |
| 4,397,401 | 8/1983 | Ueno et al. | 156/69 X |
| 4,544,093 | 10/1985 | Stark et al. | 229/43 |
| 4,730,769 | 3/1988 | Stark | 220/359 X |
| 4,887,765 | 12/1989 | Rausing | 229/125.14 X |

FOREIGN PATENT DOCUMENTS

| | | |
|---|---|---|
| 105131 | 9/1938 | Australia . |
| 018325 | 10/1980 | European Pat. Off. . |
| 2619282 | 11/1976 | Fed. Rep. of Germany . |
| 2751351 | 6/1978 | Fed. Rep. of Germany . |

*Primary Examiner*—Michael W. Ball
*Assistant Examiner*—Michele K. Yoder
*Attorney, Agent, or Firm*—Howard M. Ellis; Michael L. Dunn

[57] ABSTRACT

A pack for liquids is made at least partially from cardboard or the like, which is impervious to liquid at least on its one surface, by virtue of a plastics coating. The pack has side walls (2-3), a bottom and a top wall (1), which are connected together at least partially by fold (9) and/or sealing seams (4), a tear-open pouring opening (6) which is disposed in the top wall (1) adjacent the edge line (9) and which is preferably covered over by a tear-off cover strip (7) and a pouring edge (8) which is disposed in one plane with the top wall (1). A separate plastics strip (10) is sealed in position in the region of the pouring opening (6), covering over same, and extends beyond the edge line (9) of the top wall (1) with an unsealed end (11), forming a pouring edge (8), and the surface of the plastics strip (10), which covers over the pouring opening (6), is stamped out, exposing the opening (6), and is laid over around the edge (12) of the opening and is sealed in position from the underside.

8 Claims, 4 Drawing Sheets

METHOD FOR PRODUCING AN OPENING MEANS ON A PACK FOR LIQUIDS

Figure 1:
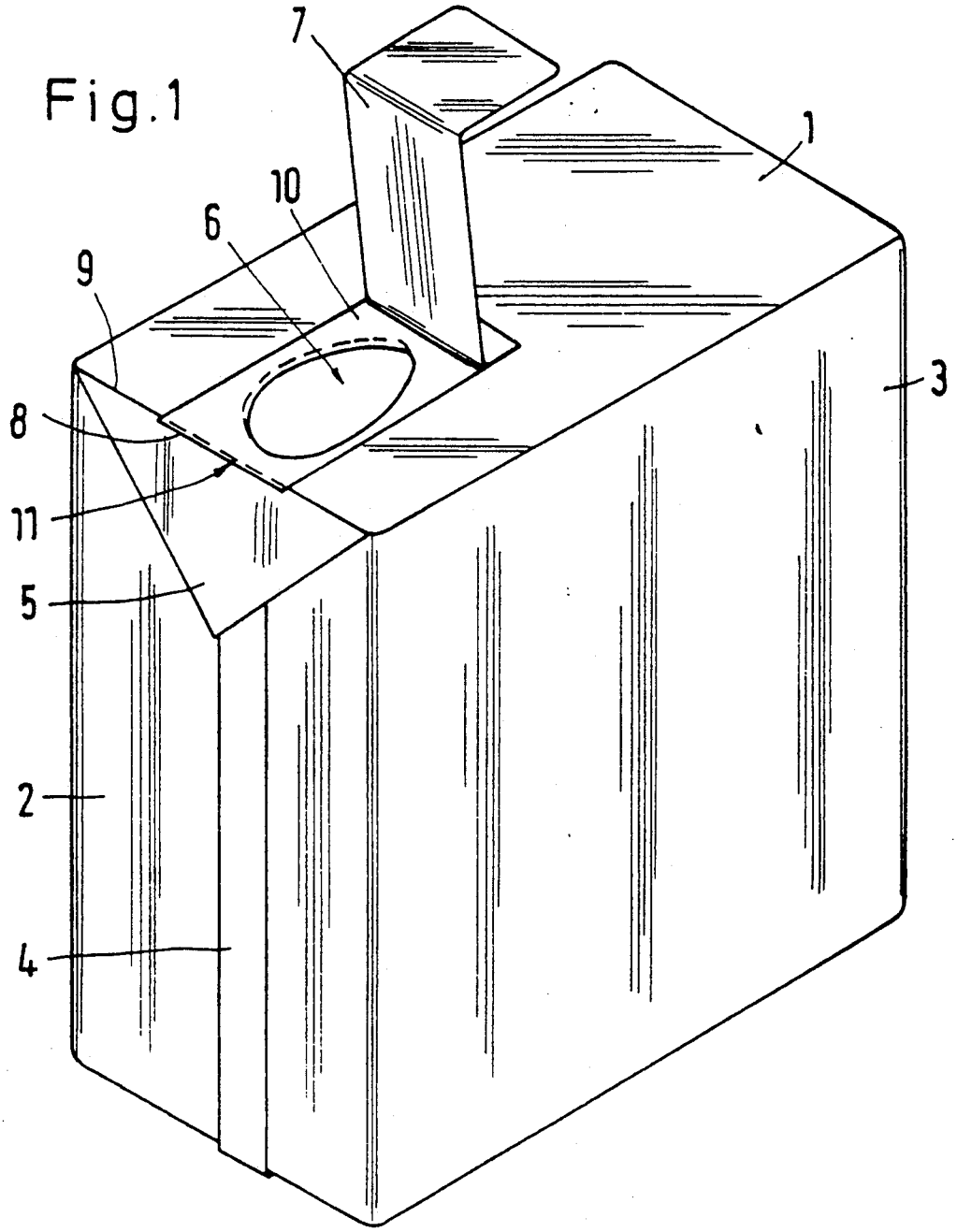

This is a divisional of application Ser. No. 07/075,281, filed Jul. 20, 1987 now U.S. Pat. No. 4,998,668 which in turn is a continuation of U.S. Ser. No. 07/826,066, filed Feb. 4, 1986 now abandoned.

This invention relates to a pack for liquids made at least partially of cardboard or the like, which is impervious to liquid at least on one surface, by virtue of a plasticscoating, which pack has side walls, a bottom and a top wall, which are connected together at least partially by fold and/or sealing means, a tear-open pouring opening which is disposed in the top wall adjacent the edge line and which is preferably covered over by a tear-off cover strip and a pouring edge which is disposed in one plane with the top wall.

Packs for containing liquid foods such as for example milk or fruit juices are known. Such packs are made of cardboard which is thinly coated with plastics material on both surfaces, and form fluid-tight strong packs which are in use at the present time in many commercial situations.

In order to permit the contents of the pack to be discharged therefrom, the packs are provided with opening means which are also already known per se in a very wide range of forms and constructions.

Such a known pack for milk is of primarily parallelepipedic shape. In order to make it easier to pour the liquid out of the pack, the pouring opening is of an elongate or oval shape and is so aligned that the major axis of the pouring opening extends at a right angle to the edge line of the top wall of the pack. This known pack also includes a cover strip which comprises plastics material and which is fitted to the top wall of the pack in such a way that it covers over both the pouring opening and also a region surrounding that opening. The cover strip is fluid-tightly connected to the top wall in an area around the pouring opening. The cover strip can be properly gripped by the consumer, by way of an unsealed end of the cover strip, and can be pulled up to open the pack. The aim is for the contents of the pack to be discharged therefrom in a regular and fairly concentrated jet.

However, it has been found that many such packs suffer from the disadvantage that the jet or flow of liquid issuing from the pack, when pouring out liquid from the pack, seeks to follow the outer surface of the pack so that it breaks up and part of the flow runs down one of the side walls. That is primarily because the edge line which is formed by folding along a bending edge when the pack is being put into shape and over which the contents of the pack runs is slightly rounded and is not so sharply defined that the flow of liquid from the pack can break away at the outside surface of the pack.

Although, in an effort to overcome that problem, it has already been proposed that a sharp pouring edge or edge at which the flow of fluid breaks away therefrom as it flows over the top wall may be formed by means of a part of the top wall which is formed by cut lines and which is taken out into the plane of the top wall, it is necessary, in order to form the above-mentioned pouring edge, to form precise cuts in the web of material for forming the pack, when producing the web, and moreover additional steps must be taken to ensure that the leakiness which results from the cuts is eliminated again. For example, plastics strips are sealed on the inside of the pack in the region of the pouring opening. It would be desirable to form a simpler configuration on the pack, for providing a pouring edge, with a small number of steps and few parts.

Another problem was found in the course of time, in connection with emptying the liquid out of the pack. The pouring opening is generally formed in the web of cardboard material which has already been coated, by a punching-out or stamping-out operation. Consequently, the edge of the pouring opening is a cut line which exposes the edge of the paper, which is not coated with plastics material. When liquids such as milk or fruit juice are poured out, the above-mentioned edge of the pouring opening becomes moist and absorbs liquid. As a result, in the region around the edge of the opening, the top wall of the pack not only suffers a reduction in strength, but the appearance of the pack is also detrimentally affected, after the contents of the pack have been only partially discharged therefrom, and the conditions in that area may also be good for bacteria so that health problems could arise. It would therefore be desirable if the above-mentioned cut edge could be covered over.

There is thus a need for a generally improved pack for liquids which uses less material, is of simpler construction and which not only has a pouring edge for a clear pouring jet or flow but which also provides an edge protection means at the edge of the punched-out pouring opening. The invention also seeks to provide a method of producing such a pack with an improved pouring means, and an apparatus for carrying out that method.

According to the present invention there is provided a pack for liquids, made at least partially from cardboard, or the like, which is impervious to liquid at least on one surface by virtue of a plastics coating, whcih pack has side walls, a bottom and a top wall, which are connected together at least partially by fold and/or sealing seams, a tear-open pouring opening which is disposed in the top wall adjacent an edge line and a pouring edge which is disposed in one plane with the top wall, wherein a separate plastics strip is sealed in position in the region of the pouring opening covering over same, and extends beyond the edge line of the top wall with an unsealed end, forming a pouring edge and wherein the surface of the plastics strip, which covers over the pouring opening is stamped out, exposing the opening and is laid over around the edge of the opening and is sealed in position from the underside.

In accordance with the invention therefore, the use of a single separate plastics strip which is sealed on to the surface of the top wall of the pack from the outside provides both a pouring edge and also an edge protection means for the edge of the pouring opening. By virtue of the edge of the plastics strip being sealed in position from the inside, there is no longer any need for an additional cover strip in the region of the interior of the pack. Both the above-indicated difficulties (pouring edge and protecting the paper) are overcome in one step.

Preferably the plastics strip is sealed on to the top wall along a closed sealing seam which extends around the pouring opening at a spacing therefrom. The step of sealing the plastics strip on to the surface of the top wall on the outside thereof provides a pouring edge which cannot be lost and which is also not torn off accidentally when removing the outer cover strip. It has been found that the above-mentioned sealing seam, in the form of a narrow or thin sealing region around the pouring opening, is sufficient for adequately fixing the plastics strip. It will be appreciated that it is alternatively also possible to provide that the plastics strip may be sealed in position over the entire surface, as far as the edge of the pouring opening; in a further specific alternative embodiment, it may be advantageous to provide for it to be sealed around the edge of the pouring opening, that is to say, in the edge region, on the outer surface. The two alternatives last mentioned above make it possible to ensure that dirt or other foreign particles cannot accumulate between the top wall and the plastics strip.

Advantageously the plastics strip is formed from a thermoplastics film or foil, the thickness of which is from 5 to 10 times the thickness of the plastics coating on the cardboard material, the thermoplastic film or foil for the plastics strip preferably being from 0.1 to 0.2 mm in thickness. In other words, the plastics strip which covers over the pouring opening as far as the edge line on the top wall of the pack is made from a comparatively stiff material, thus also really providing a sharp pouring edge, with the result that the liquid in the pack can be poured out in an improved fashion. Thermoplastic materials which are particularly suitable for use for producing the plastics strip are preferably polyethylene, polypropylene, polyvinyl chloride, polystyrene and polyester. When using individual mixes of such materials, it is also possible to achieve a desired temperature setting, that is to say, to fix a particularly desired softening temperature.

According to another aspect of the invention a method of producing the above-described opening means is provided in which a plastics strip which covers over the pouring opening that is punched out of the top wall, and which extends beyond the closest edge line, is sealed on to the region of the pouring opening, in such a way that its end remains unsealed in the region of the edge line, in which the surface which lies over the pouring opening is deep drawn to a level below the top wall and a hole is punched out of the plastics strip at a spacing from the edge of the opening, the closed edge of said hole in the plastics strip is wrapped around, and is sealed in position beside the edge of the pouring opening from the inside of the pack. Therefore, after having been fitted on to the region of the pouring opening, the plastics strip is softened and is deep-drawn while it is still in its soft condition. The plastics strip is subjected to deep drawing into the pouring opening in a downward direction towards the interior of the pack, to a level below the top wall, so that the deep-drawn surface, which is substantially parallel to the top wall, of the deep-drawn plastics strip is at a spacing beneath the top wall, in the interior of the pack. That configuration advantageously provides annular surfaces which project downwardly into the interior of the pack substantially normal to the surface of the top wall of the pack and which, before or after the operation of punching or stamping out the hole from the plastics strip itself (not to be confused with the pouring opening in the cardboard) are enlarged in a conical configuration from the interior of the pack by means of suitable tools and are sealed on to the inside surface of the top wall of the pack from the inside of the pack. In other words, a sealing seam is formed in a circular or oval configuration around the pouring opening, beside the edge thereof, which sealing seam forms a fixing or adhesion region for the plastics material, from the inside of the pack. That not only substantially improves the level of safeguard against the plastics strip being lost, but it also provides an edge protection means for protecting the edge of the pouring opening because liquid can now no longer be absorbed by and penetrate into the edge of the opening.

As already indicated above, the hole in the plastics strip may be made before or after the operation of turning it over and sealing it on to the inside of the pack.

The deep-drawing operation may be carried out by means of a vacuum or a punch member in per se known manner.

If the method is advantageously to be used in relation to a pack which is produced continuously or intermittently from a web of material which is folded into a tubular configuration, it is then desirable if, in accordance with the invention, during the operations of grooving, stamping or punching and cutting the web of cardboard material, the plastics strip is applied by being drawn from a supply roll, pushed on to the region of the pouring opening, cut and sealed in position. During the movement of the web of cardboard material which is already coated with plastics material on both sides, in the packaging machine, the appropriate cuts and sealing means may be formed, while possibly simultaneously or therebetween, the operations of grooving, stamping or punching and cutting the web of cardboard material are performed.

It is particularly advantageous for the sealing operation to be effected by high frequency welding. Another alternative is using hot air or electrically heating plates.

If, in a further embodiment of the invention, the plastics strip is applied to the top wall of the pack in a condition of being heated to such a temperature that the plastics strip can be sealed in position and subjected to deep drawing, that gives the advantage that there is no need for a separate supply of heat because the plastics strip is already set to the appropriate temperature before the sealing and deep-drawing operations.

While the position of the plastics strip on the surface of the top wall of the pack, towards the centre thereof, is more or less non-critical, the size of the plastics strip towards the edge line over which the contents of the pack are poured out in a jet is preferably desirably of the correct dimension when, in plan view perpendicularly on to the top wall of the pack, the outer edge of the plastics strip lies approximately on the line of that subjacent fold line which was referred to as the front edge line of the top wall of the pack. Specifically, that gives the advantage that the cover strip which is laid over the plastics strip on the outside thereof and folded over around the edge line on to the front side edge where it is fixed in position does not damage or bend the pouring edge. On the contrary, the comparatively stiff plastics strip remains undeformed in the plane of the top wall even during transportation prior to the pack being open. With the normal one-litre milk packs of generally square form, it has been found to be particularly appropriate for the above-mentioned front edge of the plastics strip to project beyond the above-mentioned edge line between the top wall and the side wall of the pack, by from 0.5 to 2 mm and preferably 1 mm.

According to a further aspect of the invention, apparatus for carrying out the method set out hereinbefore is provided, in which the cooperating jaw which acts against the pressing punch has a punching means. If a combination of cooperating jaw and punching or stamping means, or pressing punch and punching or stamping means is formed, it is possible to use simplified tools and thus to achieve a higher speed of operation.

For example, a machine which is provided with the apparatus according to the invention is capable of producing 6000 packs per hour in the desired manner. It is also preferred for the apparatus to have a cooperating jaw which is formed as a contact heating plate. That feature supplements the other possible ways of heating the plastics film or foil, as already referred to above, namely using hot air or high frequency welding.

Figure 2:
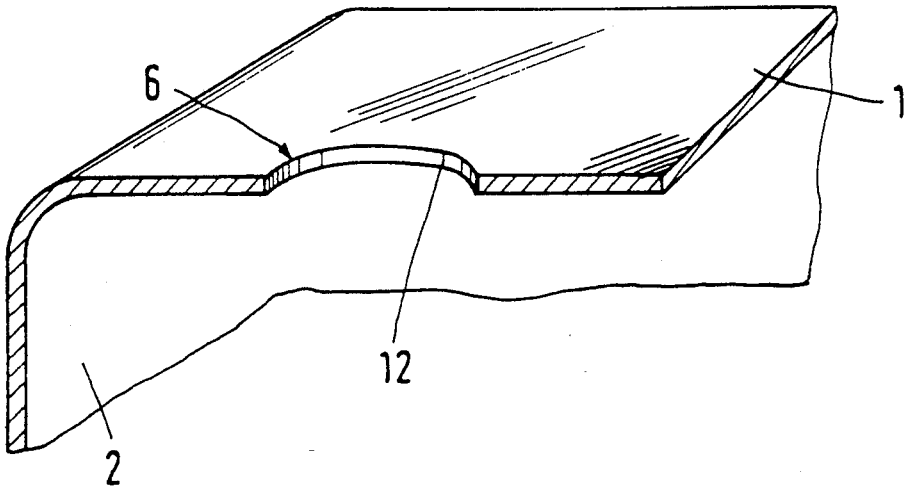
Figure 3:
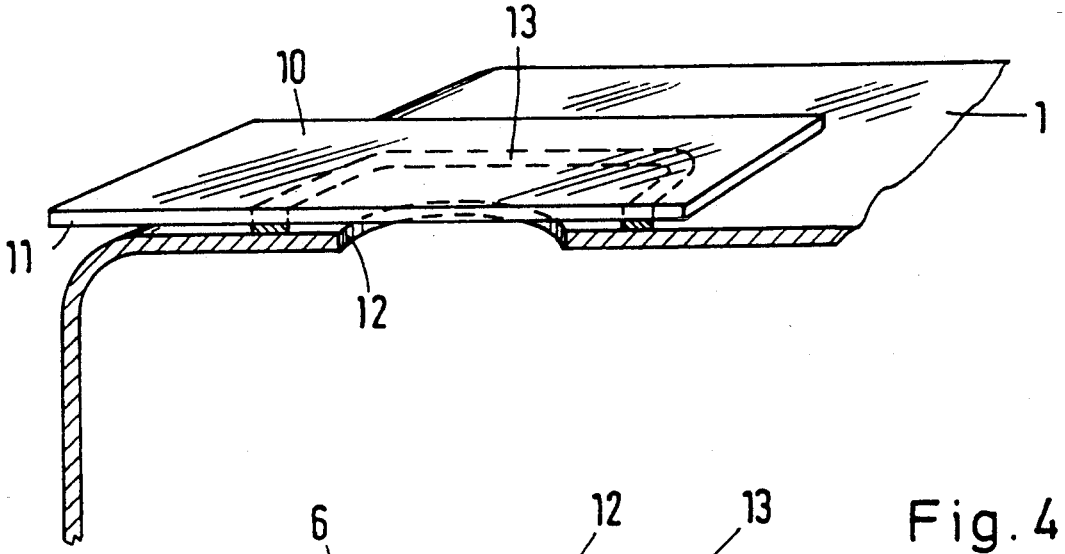
Figure 4:
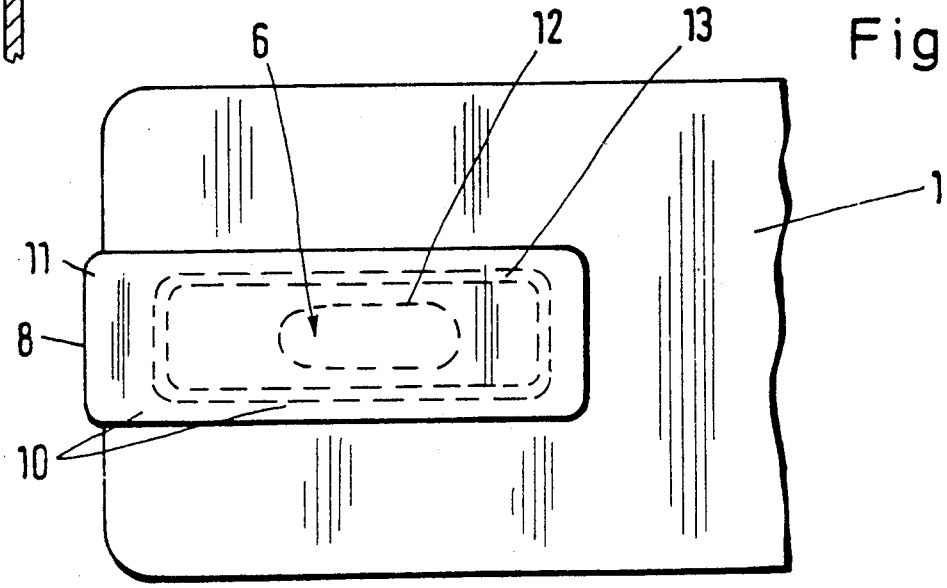
Figure 5:
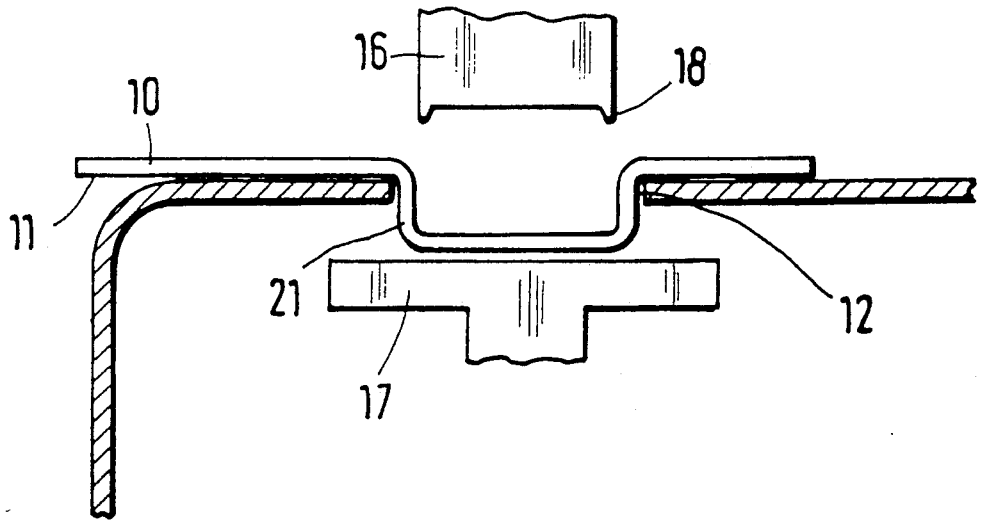
Figure 6:
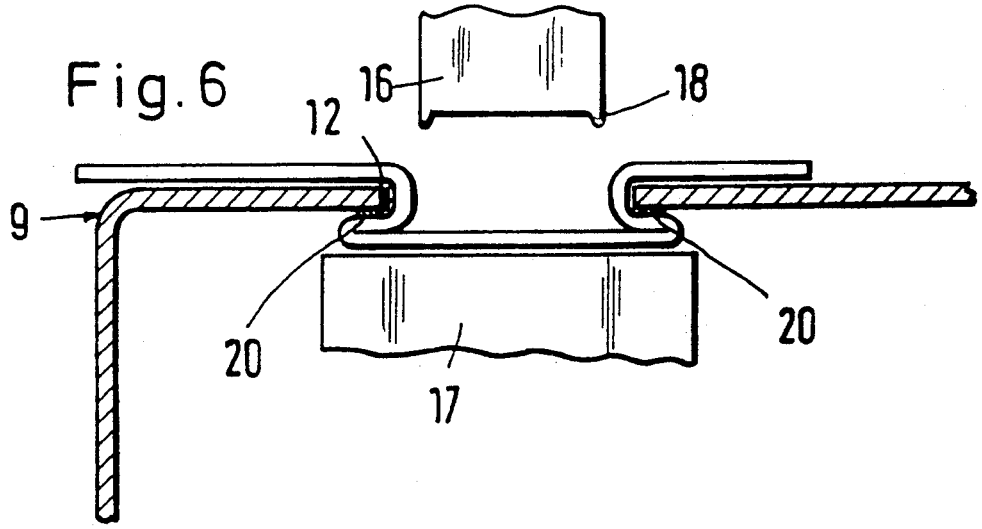
Figure 7:
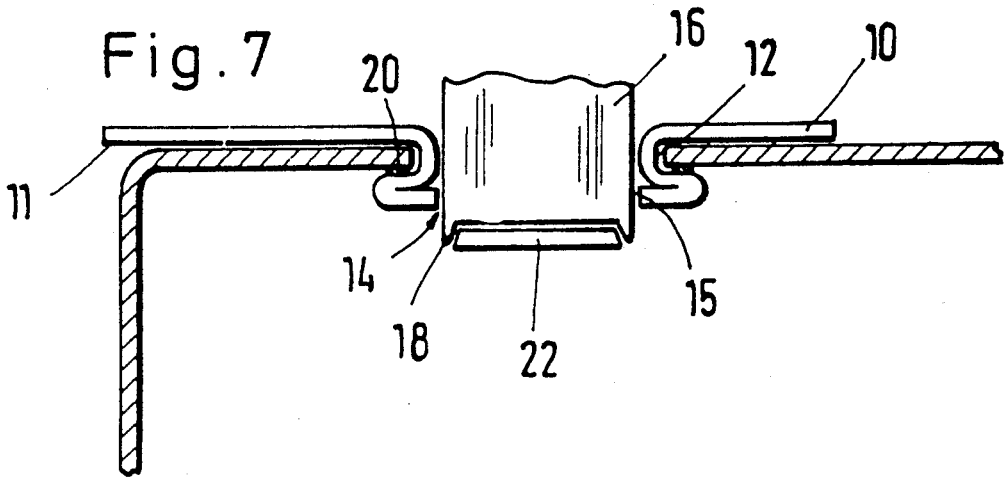
Figure 8:
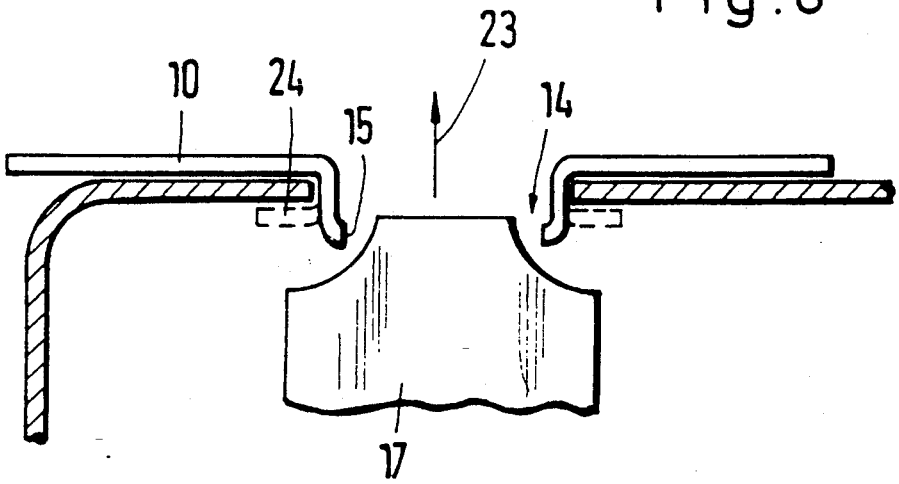
Figure 9:
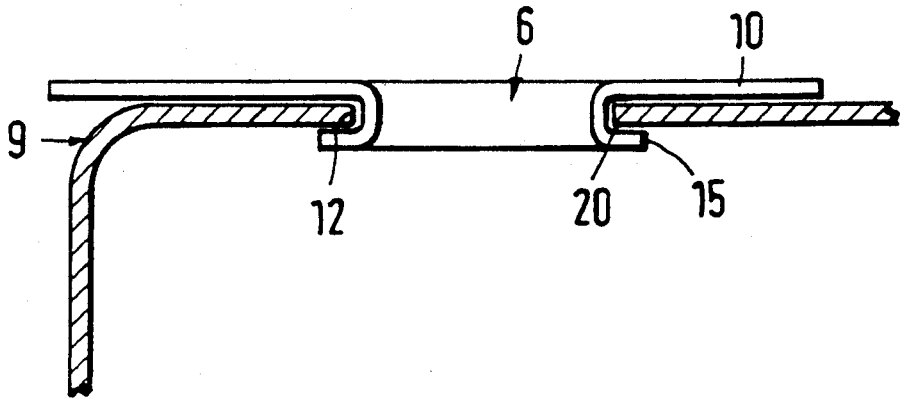

For a better understanding of the present invention, and to show how the same may be carried into effect, reference will not be made, by way of example, to the accompanying drawings in which:

FIG. 1 is a perspective view of a pack for liquids, according to the invention,

FIG. 2 is a perspective, broken-away diagrammatic cross-sectional view through the pouring opening of the pack of FIG. 1, wherein the cardboard material which is coated with plastics material on both sides is initially only provided with a pouring opening, FIG. 3 is a view similar to that shown in FIG. 2 but in which the plastics strip has been fitted on to and sealed in position on the region of the pouring opening, FIG. 4 is a plan view, also diagrammatic, of the top wall of the pack of FIGS. 1 to 3 with plastics strip sealed thereon (without the outer over strip), FIG. 5 is a diagrammatic cross-sectional view of the pack of FIGS. 1 to 4, provided with the pouring opening, with the plastics strip scaled in position thereon, in accordance with a first step in the method after the deep-drawing operation, FIG. 6 is the same view as that shown in FIG. 5, but illustrating the step in the method which next follows the step shown in FIG. 5, for sealing the flange portion on to the inside of the pack, FIG. 7 is a view similar to that shown in FIG. 6, but illustrating the operation of punching out the hole in the plastics strip, in the next step in the method, FIG. 8 shows a view similar to those shown in FIGS. 5 to 7 of another embodiment of a pressing punch, in which however the operation of sealing the plastic strip in position from the inside of the pack is effected in a different manner from that used with the embodiment shown in FIGS. 6 and 7, and FIG. 9 is a similar, diagrammatic and broken-away sectional view like that in FIG. 8, showing the plastic strip in the final applied condition, once again without the outer cover strip.

Referring firstly to FIG. 1, shown therein is a perspective view from the outside of a liquid pack of the invention. Shown in FIG. 1 is a top wall 1, a narrow side wall 2 which faces forwardly and towards the left relative to the person viewing the drawing, and a wide side wall 3 which faces forwardly and towards the right, of a liquid pack which is of approximately square configuration. The pack is made from a tube, the sealing seam 4 serving to form the tubular configuration.

A triangular flap 5 is formed at the mutually oppositely disposed narrow ends of the top wall 1, by way of an edge line 9. In the view shown in FIG. 1, the flap 5 is folded down on to the adjacent side wall 2 where it is secured in position as by adhesive.

Provided in the top wall 1 is the pouring opening 6 which is covered in per se known manner by an outer cover strip 7 (pull tab).

A separate plastic strip 10 is sealed in position in the region of the pouring opening 6, by way of the narrow sealing seam 13 on the outside, as shown in FIGS. 3 and 4, and the annular sealing surface 20 on the inside. The plastics strip 10 covers over the pouring opening 6, as can be particularly clearly seen from FIG. 3.

The plastics strip 10 projects forwardly beyond the edge line 9 of the top wall 1 by a very small amount (0.5 to 2 mm). Directly beside the pouring edge 8 which is formed by virtue of that configuration, the end 11 of the plastics strip 10 is not sealed to the top wall 4.

In order to assist the reader in understanding, it should also be said that the edge line 9 is shown as being excessively round in the sectional views of FIGS. 2, 3 and 5 to 9. The view shown in FIG. 7 comes closest to the actual bend configuration of the outer edge line 9. At any event, there are no sharply defined edges, as shown in the perspective diagrammatic view in FIG. 1.

The configuration of the entire opening mechanism with the plastics strip 10 is best seen in regard to the description of the method of production shown in FIGS. 2 to 7 in respect of the first embodiment and FIGS. 8 and 9 in respect of the second embodiment.

FIG. 2 is a diagrammatic perspective sectional view of the left-hand corner of the pack shown in FIG. 1, although the triangular flap 5 and the cover strip 7 are not shown. Firstly, only the pouring opening 6 is punched out in the top wall 1, thus giving the free edge 12 of the opening without any coating, being a cut line. Without that edge or marginal surface 12 being protected, liquid could penetrate in the region of the annular surface 12, and give rise to the softening and contamination phenomena referred to above.

As a way of providing the pouring edge 8 and also the edge protection or for covering over the edge 12 of the opening, the pack has the plastics strip 10 which, as shown in FIG. 3, is set in position on the region of the pouring opening 6. It will be seen that it covers over the pouring opening 6 and extends at least as far as the most closely adjacent edge line 9 (at the left in FIG. 1); however, it preferably extends therebeyond by a small distance of about 1 mm. In the last region, that is to say, over a strip which is from 0.5 to 3 mm in width, parallel to the pouring edge 8, the end 11 of the plastics strip 10 is without any sealing means. In the embodiment shown in FIG. 3, the plastics strip 10 is only secured to the top wall 1 on the outside by way of the sealing seam 13 so that more than the end 11 of the plastics strip 10 is seal-free. If however the pack has a larger sealing area than only the seam 13 shown in FIG. 3, as mentioned above, the end 11 should always remain seal-free with respect to the top wall 1 in the region of the edge line 9 of the plastics strip 10.

FIG. 4 shows a plan view of the plastics strip 10 when it has thus been fitted in position, with the pouring edge 8.

While the pouring opening 6 with the edge 12 is already present in the cardboard material, the plastics strip 10 is initially still generally without a hole. As shown in FIG. 5, the material of the plastics strip 10, which is over the pouring opening 6, is deep drawn into the opening 6 by the pressing mandrel or punch 17 and the co-operating jaw 16. That produces annular surfaces 21 which can subsequently be used for sealing the strip in position from the inside.

FIG. 6 shows the next step in which the entire deep-drawn bottom portion is urged upwardly by means of the punch 17. FIG. 6 shows the final condition which is achieved as a result of that operation, wherein the annular walls 21 now form a kind of flange (FIGS. 6, 7 and 9).

After the condition shown in FIG. 6 is reached, the deep-drawn part of the plastics strip 10 is now punched or stamped out by means of the punching or stamping member 18, forming a hole 14, at a spacing from the edge 12 of the opening. The punched-out circle or oval of the plastics strip is shown diagrammatically at 22 in FIG. 7. If the FIG. 7 the co-operation jaw 16 with the punching or stamping member 18 and the disc portion 22 are imagined not to be present, then the view shown in FIG. 7, even if it does not include the outer cover strip 7, shows the final condition of the plastics strip 10 which is sealed in position on the outside and on the inside (by way of the annular surface 20).

In regard to the other embodiment, the mode of operation is similar to that shown in FIGS. 2 to 5, except that the laid-over configuration of the deep-drawn part of the strip, which constitutes a rivet-like configuration in cross-section, for forming the double flange as in FIGS. 6 and 7, is not shown. Once again, the major part of the deep-drawn portion of material is punched or stamped out, thus giving the hole 14 shown in FIG. 8. Before the side flange portions of the remaining deep-drawn parts are folded or laid over on to the inside, the pressing punch 17 is in the position shown in FIG. 8. It is moved upwardly as indicated by the arrow 23 and in so doing folds the flange portions 24 over on to the inside of the pack. The flange portions 24 are then once again sealed in position, by way of the portions 20. FIG. 9 then shows the final condition reached, wherein the edge 12 of the pouring opening 6 is protected by the edge of the hole of the plastics strip 10.

I claim:

1. A method for producing an opening means on a pack for liquids which pack comprises at least one side wall, a bottom wall and a top wall, wherein the top wall is provided with a pouring opening defined by an edge, said method comprising the steps of covering the pouring opening with a single deformable plastic strip which extends beyond at least a portion of the side wall to form a drip lip; sealing said single strip to the top wall such that it remains unsealed in the region of the edge of the pouring opening; deep drawing the plastic strip into the opening to a level below the top wall; providing a hole in the plastic strip, said hole in the plastic strip having an edge in spaced relationship to the edge of the pouring opening; wrapping the edge of the hole in the plastic strip around the edge of the pouring opening; and sealing the edge of the hole in the plastic strip proximate the edge of the pouring opening from the inside of the pack, said strip remaining unsealed in the region of the edge of the pouring opening and after sealing of the hole, covering the hole with a solid cover strip which is removable.

2. The method of claim 1 wherein the plastic strip is applied by being drawn from a supply roll, applied onto the top wall in the region of the pouring opening, cut and sealed in place.

3. The method of claim 1 wherein the plastic strip is applied to the pouring opening before the pack is completely formed.

4. The method of claim 1 wherein the plastic strip is sealed to the top wall by high frequency welding.

5. The method of claim 2 wherein the plastic strip is sealed to the top wall by high frequency welding.

6. The method of claim 1 wherein the plastic strip is applied to the top wall of the pack, in a condition of being heated to such a temperature that the plastic strip can be sealed in position and subjected to deep drawing.

7. The method of claim 2 wherein the plastic strip is applied to the top wall of the pack, in a condition of being heated to such a temperature that the plastic strip can be sealed in position and subjected to deep drawing.

8. The method of claim 3 wherein the plastic strip is applied to the top wall of the pack, in a condition of being heated to such a temperature that the plastic strip can be sealed in position and subjected to deep drawing.

* * * * *